US010752474B2

(12) United States Patent
Lissandre et al.

(10) Patent No.: US 10,752,474 B2
(45) Date of Patent: Aug. 25, 2020

(54) LIFTING UNIT, LUFFING JIB CRANE COMPRISING SUCH A LIFTING UNIT AND METHOD FOR ASSEMBLING SUCH A CRANE

(71) Applicant: Manitowoc Crane Group France, Dardilly (FR)

(72) Inventors: Michel Lissandre, Sain-Bel (FR); Sylvain Raymond, Lyons (FR); Gabriel Fraisse, Lyons (FR); Michael Mollenthiel, Lyons (FR); Tania Garcia Lovera, Lyons (FR); Florent Mourin, Brignais (FR)

(73) Assignee: Manitowoc Crane Group France, Dardilly (FR)

( * ) Notice: Subject to any disclaimer, the term of this patent is extended or adjusted under 35 U.S.C. 154(b) by 271 days.

(21) Appl. No.: 16/065,322

(22) PCT Filed: Nov. 17, 2016

(86) PCT No.: PCT/FR2016/052994
§ 371 (c)(1),
(2) Date: Jun. 22, 2018

(87) PCT Pub. No.: WO2017/109309
PCT Pub. Date: Jun. 29, 2017

(65) Prior Publication Data

US 2019/0010028 A1 Jan. 10, 2019

(30) Foreign Application Priority Data

Dec. 23, 2015 (FR) ..... 15 63218

(51) Int. Cl.
*B66C 23/34* (2006.01)
*B66C 23/36* (2006.01)
(Continued)

(52) U.S. Cl.
CPC ..... *B66C 23/344* (2013.01); *B66C 23/365* (2013.01); *B66C 23/54* (2013.01);
(Continued)

(58) Field of Classification Search
CPC ..... B66C 23/02; B66C 23/022; B66C 23/06; B66C 23/16; B66C 23/36; B66C 23/365;
(Continued)

(56) References Cited

U.S. PATENT DOCUMENTS 4,383,616 A * 5/1983 Sterner ..... B66C 23/702 212/296
6,422,408 B1 * 7/2002 Lissandre ..... B66C 23/26 212/177
(Continued)

FOREIGN PATENT DOCUMENTS

CN 202936122 U 5/2013
DE 3226211 A1 7/1983
(Continued)

OTHER PUBLICATIONS

International Search Report issued by ISA/EPO in connection with PCT/FR2016/052994 dated Feb. 16, 2017.

*Primary Examiner* — Michael R Mansen
*Assistant Examiner* — Juan J Campos, Jr.
(74) *Attorney, Agent, or Firm* — Levenfeld Pearlstein, LLC

(57) ABSTRACT

A lifting unit includes a jib foot forming a proximal part of a jib in a service configuration, a counter jib supporting a balancing ballast, a securing part between the jib foot and the counter jib to secure the lifting unit to a mast, and a cylinder connected to the jib foot such that the jib foot is movable between a lowered position and a lifted position. A second cylinder is connected to the securing part.

16 Claims, 4 Drawing Sheets

(51) Int. Cl.
*B66C 23/62* (2006.01)
*B66C 23/82* (2006.01)
*B66C 23/00* (2006.01)

(52) U.S. Cl.
CPC ..... *B66C 23/62* (2013.01); *B66C 23/82* (2013.01); *B66C 2700/0392* (2013.01)

(58) Field of Classification Search
CPC ..... B66C 23/62; B66C 23/82; B66C 23/344; B66C 23/54
See application file for complete search history.

(56) References Cited

U.S. PATENT DOCUMENTS

| | | | | |
|---|---|---|---|---|
| 2014/0083964 | A1* | 3/2014 | Kurotsu | B66C 23/68 212/177 |
| 2016/0347588 | A1* | 12/2016 | Kuninaga | B66C 23/348 |
| 2017/0183203 | A1* | 6/2017 | Verchere | B66C 23/342 |

FOREIGN PATENT DOCUMENTS

| | | | |
|---|---|---|---|
| FR | 2719300 | A1 | 11/1995 |
| GB | 1374253 | A | 11/1974 |

* cited by examiner

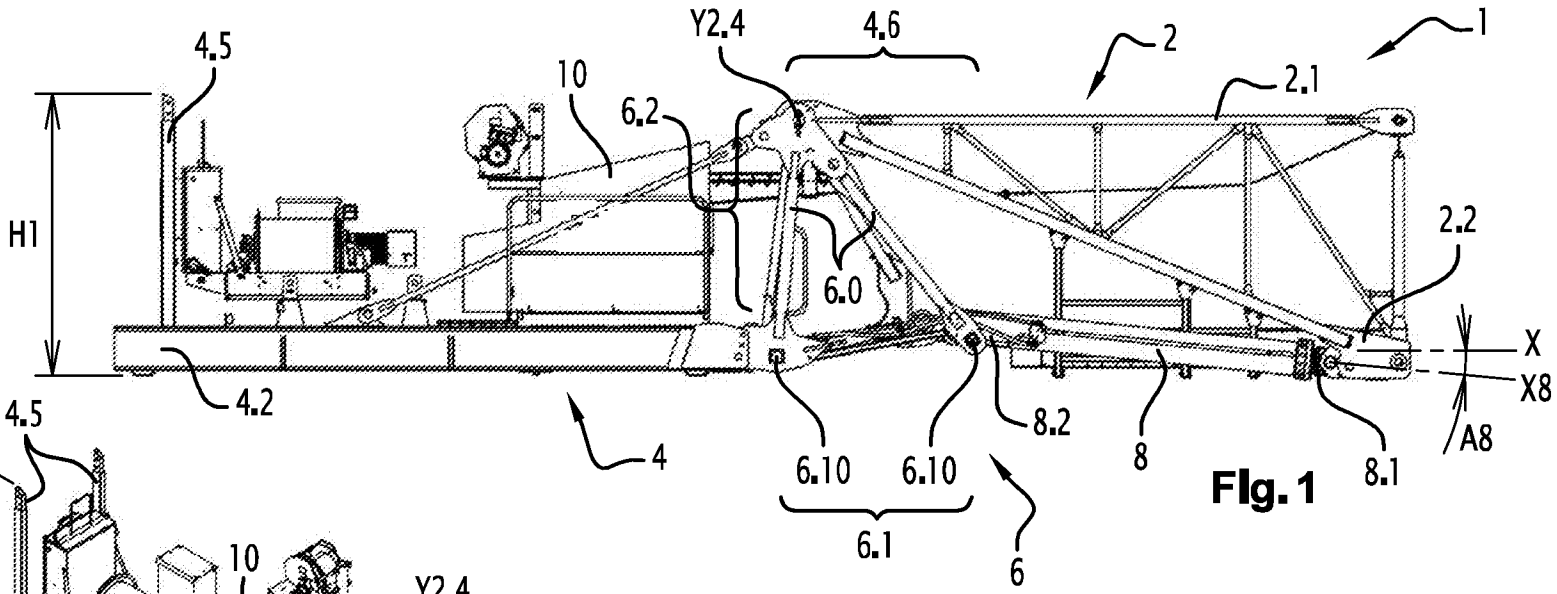
Flg. 1
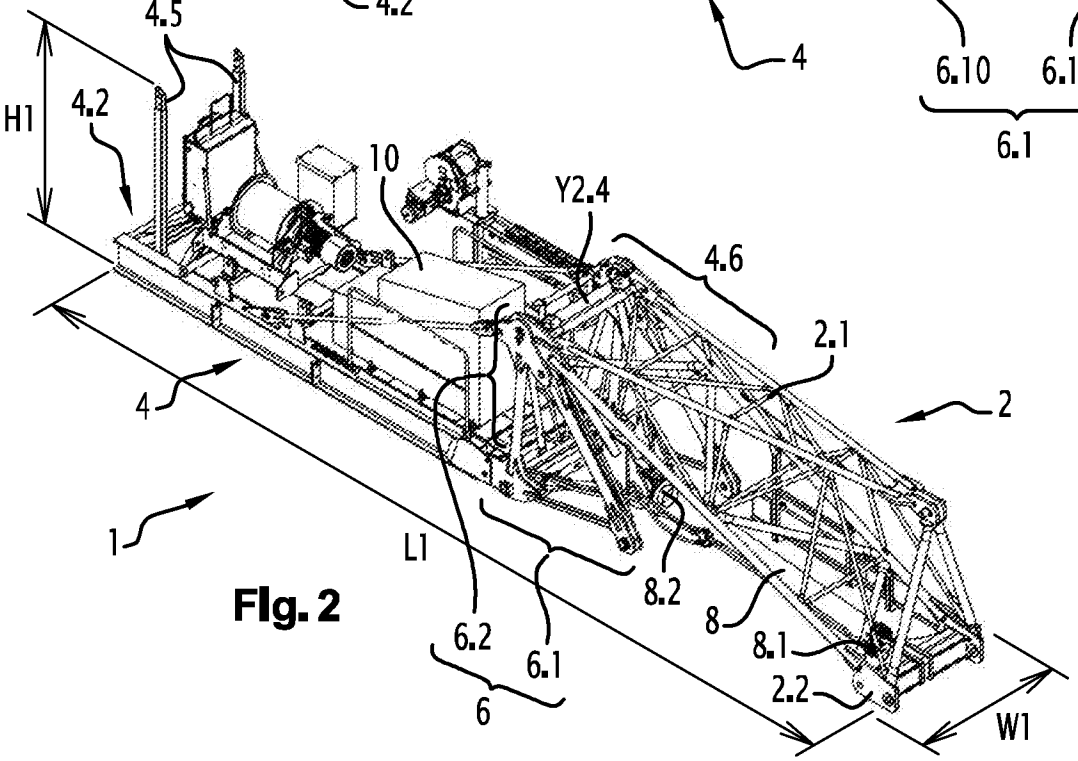
Flg. 2

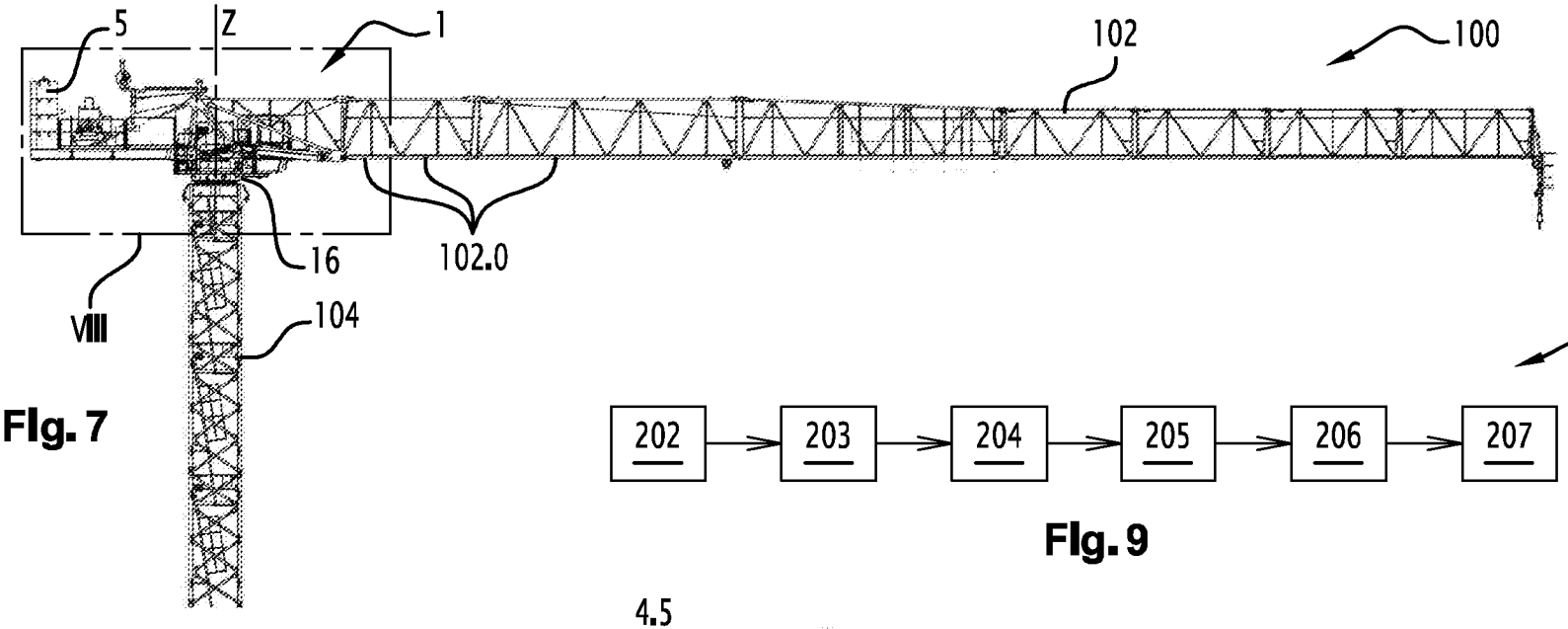
Fig. 7
Fig. 9
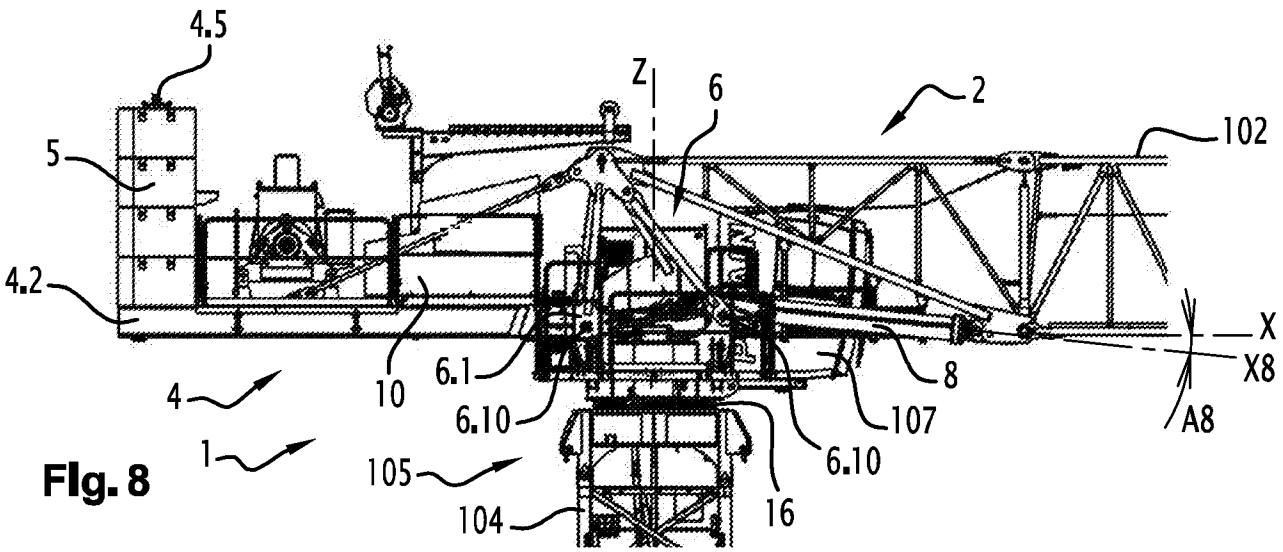
Fig. 8

LIFTING UNIT, LUFFING JIB CRANE COMPRISING SUCH A LIFTING UNIT AND METHOD FOR ASSEMBLING SUCH A CRANE

CROSS-REFERENCE TO RELATED APPLICATION(S)

This is a National Stage Application of International Patent Application No. PCT/FR2016/052994 filed Nov. 17, 2016, which claims priority to French Patent Application No. 15/63218 filed Dec. 23, 2015, both of which are incorporated herein by reference in their entireties.

FIELD

The present invention concerns a lifting unit for composing a luffing jib crane. Furthermore, the present invention concerns a luffing jib crane comprising such a lifting unit. Moreover, the present invention concerns an assembly method for assembling such a luffing jib crane.

The present invention is applied to the field of tower cranes comprising a luffing jib. The present invention may be applied to several crane structures, for example to the structures composed of lattices and chords.

BACKGROUND

GB1374253A describes a tower crane comprising a mast, a luffing jib, a lifting unit and a rotation device for rotating the lifting unit. The lifting unit of GB1374253A comprises a proximal part of the luffing jib, a counter-jib supporting a balancing ballast, a securing part arranged between the jib and the counter-jib, as well as a cylinder which is substantially vertical and which is connected, on the one hand, to the jib and, on the other hand, to the mast.

However, the lifting unit of GB1374253A is bulky, which makes it necessary to detach the cylinder from the jib and the mast before transporting the crane. However, in the disassembled configuration, the connection members between jib, cylinder and mast are exposed to shocks and pollution, which reduces their service life due to the multiple disassemblies of the crane. Furthermore, the assembly or disassembly operations of the crane are quite long. Moreover, the number of parts to be managed and stored separately is relatively large.

SUMMARY

The present invention aims in particular to solve, in whole or in part, the problems mentioned above.

For this purpose, the present invention relates to a lifting unit, for composing a luffing jib crane, the lifting unit comprising at least:

- a jib foot intended to form a proximal part of a jib belonging to the luffing jib crane when the lifting unit is in the service configuration,
- a counter-jib configured to support a ballast intended to balance the jib,
- a securing part arranged between the jib foot and the counter-jib, the securing part comprising a securing portion configured to secure the lifting unit to a mast of the luffing jib crane, and
- a cylinder comprising a first cylinder part and a second cylinder part, the first cylinder part being mechanically connected to the jib foot such that the jib foot is movable at least between a lowered position and a lifted position, the lifting unit being configured to be placed at least:

- in a service configuration, in which the cylinder may displace the jib foot between the lowered position and the lifted position, and
- in a transport configuration, in which the jib foot is in the lowered position, the lifting unit being characterized in that the second cylinder part is mechanically connected to the securing part.

In other words, the cylinder extends between the jib foot and the counter-jib. When the jib foot is in the lowered position, the cylinder is in a retracted position. Unlike the cranes of the state of the art, the second cylinder part is not mechanically connected to the mast of the crane.

Thus, such a lifting unit has a relatively small space requirement, because the cylinder is mechanically connected, on the one hand, to the jib foot and, on the other hand, to the securing part. With a relatively small space requirement, the lifting unit may be transported, assembled on a crane, then disassembled from a crane as a unitary block, that is to say by preserving all its components (jib foot, counter-jib, securing part, cylinder) mechanically connected together.

Consequently, the connection members of the jib foot, the securing part, the counter-jib and the cylinder may remain mechanically connected permanently, particularly during the initial factory assembly, during the transport, the storage, the mounting, the dismounting, the corrective or preventive maintenances of the lifting unit.

These permanent connections allow protecting the connection members against shocks or pollution, particularly the balls of the jib foot and the joints of the cylinder, therefore maximizing their service life. Indeed, the balls of the jib foot and the joints of the cylinder always remain mechanically connected to the structure of the lifting unit. However, in a crane of the state of the art, the connection members, which are relatively fragile, may be damaged during the multiple assemblies and disassemblies.

Furthermore, a lifting unit according to the invention allows reducing the duration of the assembly or disassembly operations of the luffing jib crane. Moreover, such a lifting unit improves the safety of the operators responsible for these assembly or disassembly operations. Furthermore, such a lifting unit reduces the number of parts to be managed and stored separately, because all components of the lifting unit remain secured to each other.

The jib foot corresponds to the base of the jib, that is to say to the proximal part of the jib. The jib foot generally includes a pivot axis, about which the cylinder lifts or lowers the jib when the lifting unit is in service. The jib foot is movable between a lowered position and a lifted position when the lifting unit is in service.

In the present application, the terms "proximal" and "distal" characterize a member according to its close or remote position relative to the counter-jib. Thus, a proximal member is relatively close to the counter-jib, while a distal member is relatively remote from the counter-jib.

According to a variant, the securing part comprises a punch.

According to a variant, the securing portion is configured to be secured by embedding to the top of the mast of the luffing jib crane.

According to a variant, the securing part has a generally triangular section in a vertical plane including the vertical axis about which the jib rotates when the luffing jib crane is in service. The securing part may for example have a prismatic shape with a triangular base or a tetrahedral shape with a triangular base.

According to a variant, the lifting unit further comprises a hoisting winch intended to lift a load suspended from the jib.

According to a variant, the securing part directly connects the jib foot to the counter-jib. Alternatively, the securing part may indirectly connect the jib foot to the counter-jib, that is to say with at least one intermediate component between the jib foot and the counter-jib.

By definition, the counter-jib is arranged opposite to the jib foot relative to the securing portion. The counter-jib is arranged opposite to the jib foot relative to the mast when the lifting unit is assembled on the luffing jib crane in the service configuration. Thus, the counter-jib performs the function of counterweight to compensate for the dead weight of the jib plus the weight of the load suspended from the jib.

According to an embodiment, the securing part further comprises a connection portion which is configured to mechanically connect the jib foot to the counter-jib.

Thus, such a connection portion ensures the mechanical cohesion of several components of the lifting unit.

According to an embodiment, the first cylinder part and the second cylinder part are each equipped with a ball joint, and the first cylinder part and the second cylinder part are mechanically connected respectively to the jib foot and to the securing part not only in the service configuration but also in the transport configuration.

In other words, the cylinder remains secured to the jib foot at each mounting and dismounting of the luffing jib crane. It is therefore not necessary to separate the cylinder from the jib foot.

Thus, the lifting unit forms a unitary block easy to transport, to assemble on a crane and to disassemble from a crane. Furthermore, this unitary block protects the cylinder.

According to an embodiment, the cylinder is located generally between a distal region of the jib foot and the securing part.

Thus, such a cylinder does not exceed or little a volume delimited by the jib foot and the counter-jib. The lifting unit has a small space requirement, which makes it easy to transport and handle.

According to a variant, the cylinder is totally located in a volume delimited, on the one hand, by the jib foot and, on the other hand, by the counter-jib.

According to an embodiment, the cylinder is a linear cylinder configured to move from a retracted position, in which the jib foot is in the lowered position, to a deployed position, in which the jib foot is in the lifted position, the cylinder in the retracted position extending in a cylinder direction which forms an angle comprised between −30 degrees and +30 degrees with a horizontal direction when the lifting unit is in the transport configuration.

Thus, the lifting unit may be stored and transported in a conventional container (40 feet) whose bottom wall is horizontal.

According to a variant, when the cylinder is in the retracted position, the cylinder direction is substantially parallel to the horizontal direction.

According to a variant, the first cylinder part is located on a distal end portion of the cylinder, and the second cylinder part is located on a proximal end portion of the cylinder. For example, the first cylinder part may be located at the distal end of the cylinder, and the second cylinder part may be located at the proximal end of the cylinder.

According to an embodiment, the cylinder is configured to be in the retracted position when the lifting unit is in the transport configuration.

Thus, the lifting unit is particularly compact in the transport configuration. Furthermore, the cylinder rod is protected in this transport configuration.

According to a variant, the cylinder is also in the retracted position when the lifting unit is in the handling, storage, mounting, dismounting and maintenance phases. Thus, the cylinder may be protected, particularly its rod, against the aggressions, shocks, corrosions and external pollution during all the handling of the cylinder.

According to an embodiment, the jib foot comprises an upper part and a lower part, the upper part being located above the lower part when the lifting unit is in the service configuration with the jib foot in the lowered position. The lifting unit further comprises a pivot axis arranged between the jib foot and the counter-jib such that the pivot axis is located higher than the lower part when the lifting unit is in the service configuration with the jib foot in the lowered position. The upper part is attached to the pivot axis and the lower part is attached to the first cylinder part, such that the cylinder may push the jib along an axis extending substantially in the extension of the lower chords of the jib when the lifting unit is in the service configuration with the lowered jib foot.

Thus, such a position of the pivot axis, about which the cylinder lifts or lowers the jib, frees a space allowing to implant the cylinder and form a rigid assembly. In addition, such a position of the pivot axis allows freeing a space sufficient to house the cylinder, such that the cylinder may push the jib with a relatively significant force while authorizing a global space requirement easily transportable when the cylinder is in the retracted position.

According to a variant, the pivot axis is located substantially at the altitude of the upper part when the lifting unit is in the service configuration with the lowered jib foot. Thus, this allows keeping the fluid and/or electrical connections of the cylinder in the retracted position when the lifting unit is in the transport (compact) configuration. Conversely, in the state of the art, the cylinder generally bears on the vertical mast of the luffing jib crane, which implies disconnecting the cylinder before transporting the components of the luffing jib crane.

According to an embodiment, the pivot axis is mechanically connected to the securing part not only in the service configuration but also in the transport configuration.

According to a variant, the pivot axis is provided with ball joints.

According to an embodiment, the lifting unit further comprises a supply device configured to a supply power to the cylinder so as to lift the jib foot, the supply device being attached to the counter-jib such that the supply device may be transported with the counter-jib when the lifting unit is in the transport configuration.

Thus, such a supply device of the cylinder is transportable with the other components of the lifting unit, which avoids the need to dismount the supply device.

Alternatively, the supply device is removably attached to the counter-jib. Thus, the supply device may be detached and transported separately from the other components of the lifting unit or the handling or mounting machine, which is useful when the transport vehicle has a small capacity.

According to an embodiment, the cylinder is a hydraulic linear cylinder, and the supply device is a hydraulic power unit.

Alternatively to this embodiment, the cylinder is an electric linear cylinder, and the supply device is an electric power unit.

According to an embodiment, the lifting unit further comprises:

conduits to conduct the liquid between the supply device and the cylinder, and quick couplers arranged between the cylinder and the supply device, the quick couplers being located closer to the supply device than to the cylinder.

Thus, such quick couplers limit the risks of leakage and pollution of the energy transmission liquid (example: oil) in the cylinder, because the conduits may remain connected to the hydraulic linear cylinder even when the hydraulic power unit is dismounted. Furthermore, all dismountable members (cylinder, quick coupler) are grouped in the same area, which facilitates the maintenance works.

According to a variant, the quick couplers are placed in the junction region between the counter-jib and the securing part.

According to a variant, the hydraulic power unit is located near the cylinder.

According to an embodiment, the lifting unit has a maximum length of less than 12 meters (m), a maximum width of less than 2.25 m and a maximum height of less than 2.5 m.

Thus, the space requirement of the lifting unit substantially corresponds to the road, rail or maritime transport templates. For example, the space requirement of the lifting unit is smaller than the volume of a conventional container 40 feet long, which allows easily transporting the lifting unit. Therefore, these dimensions allow the jib foot to always remain connected to the counter-jib via the securing part.

According to an embodiment, the securing part comprises chords assembled so as to form an undeformable assembly.

Thus, such an undeformable assembly forms, on one side, a part embedded in the mast to support the counter-jib and, on the other side, a joint support for the jib foot, therefore for the arrow.

According to a variant, the chords of the securing part are assembled in a dismountable manner.

Alternatively to this variant, the chords of the securing part are assembled in a dismountable manner. In other words, the securing part is formed in one piece.

According to a variant, the counter-jib and the securing portion are formed in one piece. In this variant, the securing portion extends the counter-jib at the top of the mast.

According to a variant, the lifting unit further comprises a rotation device which is configured to rotate the lifting unit about a substantially vertical axis when the lifting unit is in service. Thus, such a rotation device may be transported in the unitary block forming the lifting unit, which avoids the need to mount and dismount the rotation device.

Furthermore, the present invention relates to a luffing jib crane comprising:

a jib configured to distribute a suspended load, a mast configured to support the jib and the suspended load, and a lifting unit according to the invention, the lifting unit being mechanically connected to the mast and secured to the jib.

According to a variant, the rotation device includes a cabin unit. Alternatively, the cabin unit and the rotation device may be assembled separately.

According to a variant, the luffing jib crane further comprises a rotation device configured to rotate the lifting unit and the luffing jib about a substantially vertical axis when the luffing jib crane is in service.

According to an embodiment, the counter-jib and the securing part are mechanically connected by embedding.

Moreover, the present invention relates to a method for assembling a luffing jib crane according to the invention, comprising the steps of:

erecting the mast, attaching on the mast a rotation device belonging to the lifting unit, assembling the lifting unit on the rotation device, mechanically connecting the jib to the jib foot.

Thus, such an assembly method allows reducing the disassembly duration of a luffing jib crane.

According to a variant, the assembly method further comprises a step consisting in balancing the luffing jib crane by placing the ballast on the counter-jib.

According to a variant, the assembly method further comprises a step consisting in setting up security. After this setting step, the cylinder may push the jib foot, therefore lift the jib.

The embodiments and variants mentioned above may be taken individually or according to any technically possible combination.

BRIEF DESCRIPTION OF THE DRAWINGS

The present invention will be well understood and its advantages will also emerge in the light of the following description, given only by way of non-limiting example and made with reference to the appended figures, in which identical reference signs correspond to structurally and/or functionally identical or similar objects. In the appended figures:

FIG. 1 is a side view of a lifting unit in accordance with the invention, in a transport configuration;

FIG. 2 is a perspective view of the lifting unit of FIG. 1;

FIG. 7 is a side view of a part of a luffing jib crane in accordance with the invention and comprising the lifting unit of FIG. 1;

FIG. 8 is a view on a larger scale of the detail VIII in FIG. 7; and

FIG. 9 is a flowchart illustrating an assembly method in accordance with the invention.

DESCRIPTION

Figure 3:
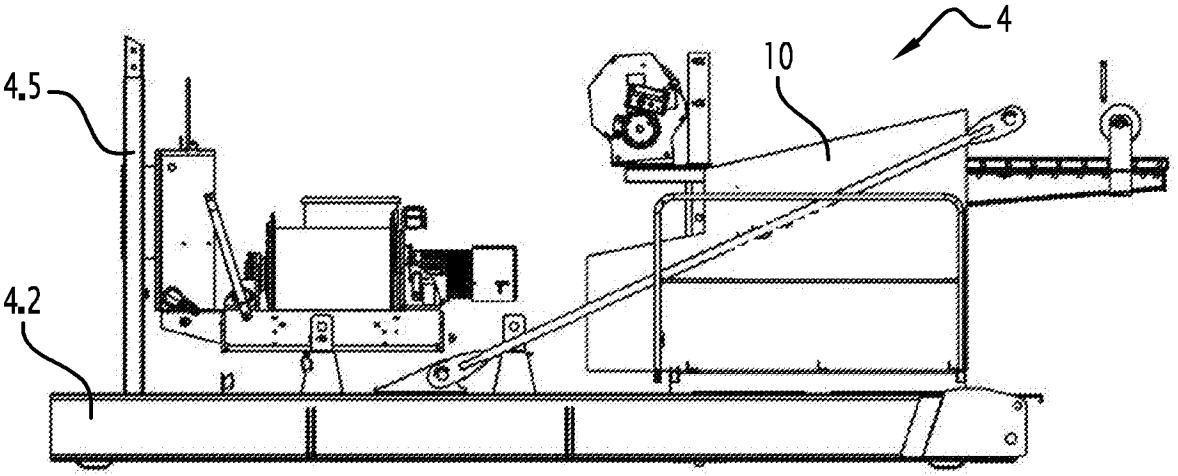
FIG. 3 is a side view of a counter-jib composing the lifting unit of FIG. 1.
Figure 4:
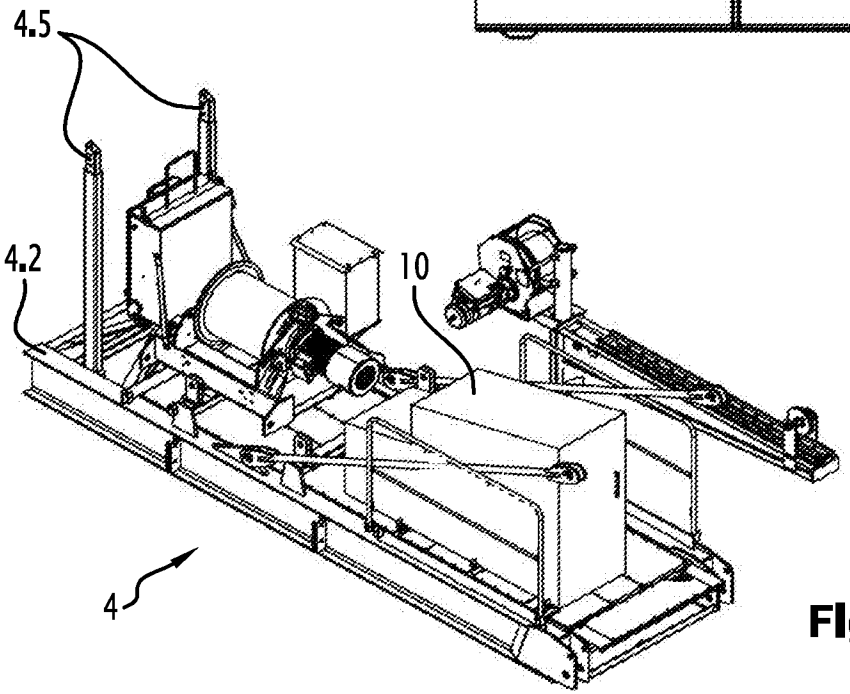
FIG. 4 is a perspective view of the counter-jib of FIG. 3.

FIGS. 1, 2, 3, 4, 5 and 6 illustrate a lifting unit 1 in accordance with the invention, to compose a luffing jib crane 100. The luffing jib crane 100 is illustrated in FIGS. 8 and 9. The luffing jib crane 100 comprises:

a jib 102, which is configured to distribute a suspended load which is not shown, a mast 104, which is configured to support the jib and the suspended load, the lifting unit 1, which is mechanically connected to the mast 104 and secured to the jib 102, as described below, and a cabin unit 107, which is here attached on the mast 104.

The lifting unit 1 comprises a jib foot 2, a counter-jib 4, a securing part 6 and a cylinder 8. The lifting unit 1 is configured to be placed:

in a service configuration (FIGS. 7 and 8), in which the cylinder 8 may displace the jib foot 2 between a lowered position and a lifted position, and in a transport configuration (FIG. 2), in which the jib foot 2 is in the lowered position and the cylinder 8 is in the retracted position.

In the transport configuration (FIG. 2), the lifting unit 1 has a maximum length L1 of less than 12 m, a maximum width W1 of less than 2.25 m and a maximum height H1 of less than 2.5 m.

The jib foot 2 is intended to form the proximal part of the jib 102 when the lifting unit 1 is in the service configuration (FIGS. 7 and 8).

The counter-jib 4 is configured to support a ballast 5 intended to balance the jib 102. To this end, the counter-jib 4 comprises i) a rear part 4.2 having a space for receiving the ballast 5 and ii) retaining rods 4.5 arranged to guide and retain the ballast 5. The bottom of the counter-jib 4 comprises a platform extending from the rear part 4.2 to the securing part 6. When the lifting unit 1 is in service, the ballast 5 supported by the counter-jib 4 serves to balance the jib 102 vis-à-vis the dead weight and the lifted load.

The securing part 6 comprises:

a securing portion 6.1 configured to secure the lifting unit 1 to the mast 104; and a connection portion 6.2 which is configured to mechanically connect the jib foot 2 to the counter-jib 4.

In the example of the figures, the securing portion 6.1 is configured to be secured by embedding to the top 105 of the mast 104. To this end, the securing portion 6.1 is here secured to the top 105 of the mast 104 by shafts 6.10. The counter-jib 4 and the connection portion 6.2 are here mechanically connected by embedding, therefore secured together and without degree of mobility therebetween.

The connection portion 6.2 is arranged between the jib foot 2 and the counter-jib 4. The connection portion 6.2 connects, here directly, the jib foot 2 to the counter-jib 4. The jib foot 2 and the counter-jib 4 are therefore mechanically connected via the connection portion 6.2.

The securing part 6 here comprises chords 6.0 assembled so as to form an undeformable assembly. The chords 6.0 are here assembled in a dismountable manner. As the securing part 6 supports the jib 102 when the luffing jib crane 100 is in service, the securing part 6 is sometimes referred to as a "jib carrier".

The securing part 6 has a generally triangular section in a vertical plane including the substantially vertical axis Z about which the jib 102 rotates when the luffing jib crane 100 is in service. The securing part 6 here has a prismatic shape with a triangular base, as shown in FIG. 2.

The cylinder 8 comprises a first cylinder part 8.1 and a second cylinder part 8.2.

The first cylinder part 8.1 is mechanically connected to the jib foot 2 such that the jib foot 2 is movable between the lowered position and the lifted position. When the luffing jib crane 100 is in service, the cylinder 8 allows lifting or lowering the jib 102, via the jib foot 2. In the example of the figures, the first cylinder part 8.1 is located at the distal end of the cylinder 8. The first cylinder part 8.1 is mechanically connected to the jib foot 2 by a pivot connection about a pivot axis Y8.1 visible in FIGS. 5 and 6.

The second cylinder part 8.2 is mechanically connected to the connection portion 6.2. In the example of the figures, the second cylinder part 8.2 is located on the proximal end of the cylinder 8. The second cylinder part 8.2 is mechanically connected to the connection portion 6.2 by a pivot connection about a pivot axis Y8.2 visible in FIGS. 5 and 6.

The cylinder 8 is here a hydraulic linear cylinder, which is configured to move from a retracted position, in which the jib foot 2 is in the lowered position, to a deployed position, in which the jib foot 2 is in the lifted position.

The first cylinder part 8.1 and the second cylinder part 8.2 are each equipped with a ball joint. The first cylinder part 8.1 is mechanically connected to the jib foot 2, by its ball joint, not only in the service configuration but also in the transport configuration. Similarly, the second cylinder part 8.2 is mechanically connected, by its ball joint, to the connection portion 6.2 not only in the service configuration but also in the transport configuration.

The lifting unit 1 further comprises a supply device 10 which is configured to supply power to the cylinder 8 so as to lift the jib foot 2. The supply device 10 is here a hydraulic power unit configured to supply the cylinder 8 with hydraulic energy. When supplied with energy, the cylinder 8 may lift the jib foot 2. The supply device 10 is here located relatively close to the cylinder 8, opposite to the location provided for the ballast 5.

The supply device 10 is attached to the counter-jib 4. The supply device 10 can thus be transported with the counter-jib 4 when the lifting unit 1 is in the transport configuration. The supply device 10 may remain attached to the counter-jib 4.

The cylinder 8 is a linear cylinder configured to move:

from a retracted position (FIGS. 2, 5 and 6), in which the jib foot 2 is in the lowered position; the cylinder 8 is in the retracted position when the lifting unit 1 is in the transport configuration;

to a deployed position, in which the jib foot 2 is in the lifted position.

The cylinder 8 extends between the jib foot 2 and the counter-jib 4. The cylinder 8 is located generally between a distal region of the jib foot 2 and the securing part 6. The cylinder 8 is here totally located in a volume delimited, on the one hand, by the jib foot 2 and, on the other hand, by the counter-jib 4.

When the cylinder 8 is in the retracted position, the cylinder direction X8 here forms an angle A8 equal to about −20 degrees with the horizontal direction X, as shown in FIGS. 1 and 8. The cylinder 8 is in the retracted position when the lifting unit 1 is in the transport configuration. The cylinder 8 is also in the retracted position when the lifting unit 1 is in the handling, storage, mounting, dismounting and maintenance phases. The cylinder 8 may also be in the retracted position when the lifting unit 1 is in the service configuration with the jib foot 2 in the lowered position.

The lifting unit 1 further comprises conduits 12 to conduct the liquid between the supply device 10 and the cylinder 8. Furthermore, the lifting unit 1 comprises quick couplers 14 arranged between the cylinder 8 and the supply device 10. The quick couplers 14 are located closer to the supply device 10 than the cylinder 8. The quick couplers 14 may be placed in the junction region 4.6 between the counter-jib 4 and the securing part 6.

Figure 5:
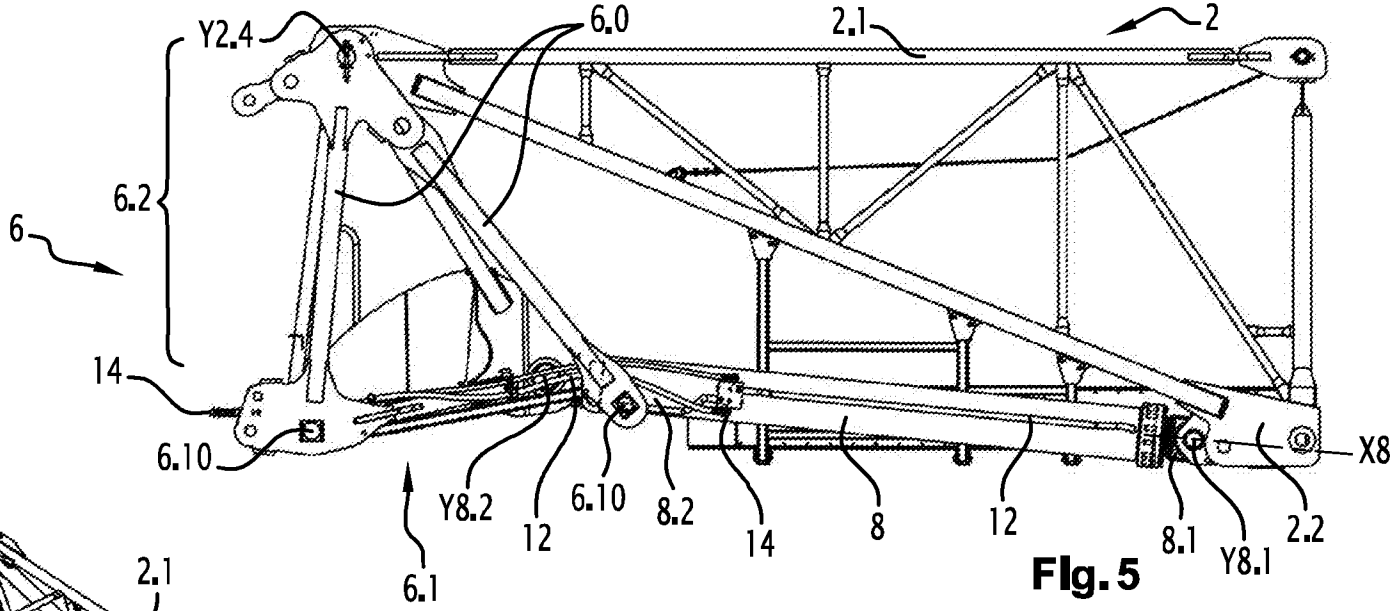
FIG. 5 is a side view of several components of the lifting unit of FIG. 1.
Figure 6:
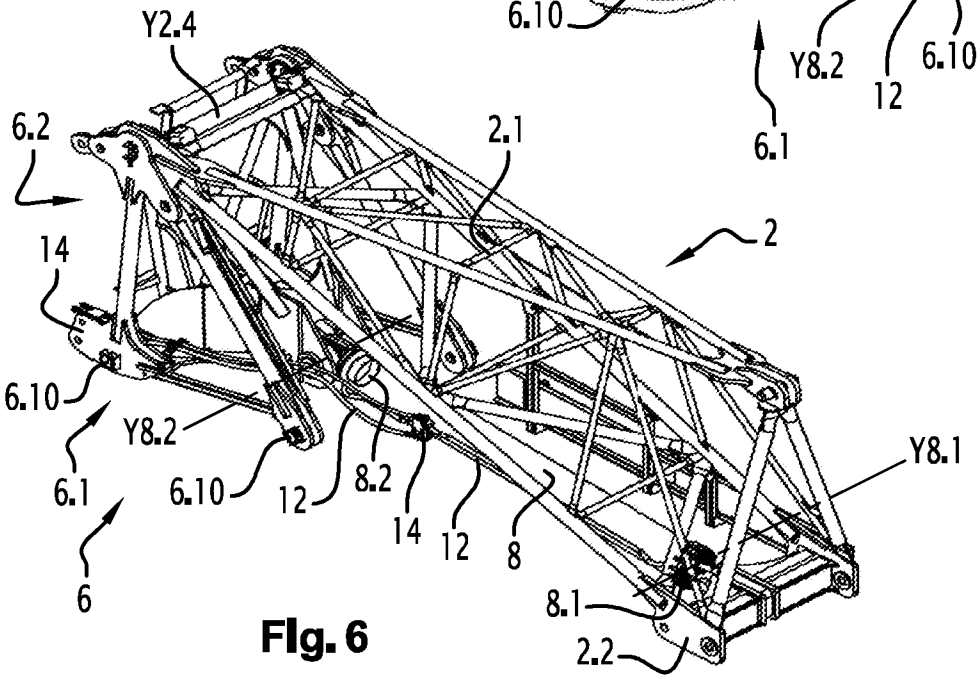
FIG. 6 is a perspective view of the components illustrated in FIG. 5.

The jib foot 2 comprises an upper part 2.1 and a lower part 2.2. The upper part 2.1 is located above the lower part 2.2 when the lifting unit 1 is in service configuration with the lowered jib foot 2 (FIGS. 5 and 6).

The lifting unit 1 further comprises a pivot connection having a pivot axis Y2.4. The pivot axis Y2.4 is arranged between the jib foot 2 and the counter-jib. Thus, the pivot axis Y2.4 is located higher than the lower part 2.2 when the lifting unit 1 is in the service configuration with the lowered jib foot 2 (FIGS. 5 and 6). The pivot axis Y2.4 is here substantially located at the altitude of the upper part 2.1 when the lifting unit 1 is in the service configuration with the lowered jib foot 2.

The upper part 2.1 is attached to the pivot axis Y2.4 and the lower part 2.2 is attached to the first cylinder part 8.1. The cylinder 8 may thus push the jib 2 along an axis of extension extending substantially in a direction of the extension of the lower chords 102.0 of the jibs 102 when the lifting unit 1 is in the service configuration with the lowered jib foot 2 (FIGS. 5 and 6). This axis of extension corresponds here to the horizontal direction X shown in FIG. 1.

When the luffing jib crane 100 is in service, with the lifting unit 1 in service, the jib foot 2 forms the proximal part of the jib 102. To this end, the jib foot 2 includes the pivot axis Y2.4, about which the cylinder 8 lifts or lowers the jib 102. The jib foot 2 is movable between a lowered position (FIGS. 5, 6, 8 and 9) and a lifted position when the lifting unit 1 is in service.

The pivot axis Y2.4 is mechanically connected to the securing part 6 not only in the service configuration but also in the transport configuration. The pivot axis Y2.4 is provided with ball joints.

The lifting unit 1 can be transported as a unitary block keeping all its components mechanically connected together. The connection members of the jib foot 2, the counter-jib 4, the securing part 6 and the cylinder 8 may remain (mechanically, hydraulically and/or electrically) connected permanently.

Furthermore, the lifting unit 1 here comprises a rotation device 16 which is configured to rotate the lifting unit 1 and the luffing jib 102 relative to the mast 104 and about the substantially vertical axis Z when the luffing jib crane 100 is in service. The rotation device 16 is usually called the slewing crown.

As shown in FIGS. 8 and 9, when the securing portion 6.1 is secured to the mast 104, the securing part 6 allows supporting the counter-jib 4 on one side and supporting the jib foot 2, therefore the whole jib 102, on the other side. When the lifting unit 1 is in the service configuration, the counter-jib 4 is arranged opposite the jib foot 2 relative to the mast 104.

The lifting unit 1 further comprises a hoisting winch intended to lift a load suspended from the jib 102.

FIG. 9 illustrates an assembly method 200 in accordance with the invention. The assembly method 200 comprises in particular the steps of:

202) erecting the mast 104,

203) attaching the rotation device 16 on the mast 104,

204) assembling the other components of the lifting unit 1 on the rotation device 16,

205) mechanically connecting the jib 102 to the jib foot 2, and

Furthermore, the assembly method 200 here comprises a step 206 consisting in balancing the luffing jib crane 100 by placing the ballast 5 on the counter-jib 4.

Furthermore, the assembly method 200 comprises a step 207 consisting in setting up security. After this setting step 207, the cylinder 8 may push the jib foot 2, therefore lift the jib 102.

Of course, the present invention is not limited to the particular embodiments described in this present patent application, nor to embodiments within the reach of those skilled in the art. Other embodiments may be considered without departing from the scope of the invention, from any member equivalent to a member indicated in the present patent application.

The invention claimed is:

1. A lifting unit for a luffing jib crane, the lifting unit comprising:

a jib foot configured to form a proximal part of a jib of the luffing jib crane;

a counter-jib configured to support a ballast for balancing the jib;

a securing part arranged between the jib foot and the counter-jib, the securing part comprising a securing portion configured to be secured to a mast of the luffing jib crane; and a cylinder comprising a first cylinder part and a second cylinder part, wherein the first cylinder part is mechanically connected to the jib foot such that the jib foot is movable between a lowered position and a lifted position, and the second cylinder part is mechanically connected to the securing part, wherein the lifting unit is configured to be placed in:

a service configuration in which the cylinder is configured to move the jib foot between the lowered position and the lifted position, and a transport configuration in which the jib foot is in the lowered position.

2. The lifting unit of claim 1, wherein the securing part further comprises a connection portion configured to mechanically connect the jib foot to the counter-jib.

3. The lifting unit according to claim 1, wherein the first cylinder part and the second cylinder part are each equipped with a ball joint, and wherein the first cylinder part and the second cylinder part are mechanically connected respectively to the jib foot and to the securing part in both the service configuration and the transport configuration.

4. The lifting unit of claim 3, wherein the cylinder is located generally between a distal region of the jib foot and the securing part.

5. The lifting unit of claim 1, wherein the cylinder is a linear cylinder configured to move from a retracted position in which the jib foot is in the lowered position, to a deployed position in which the jib foot is in the lifted position, wherein the cylinder extends in a cylinder direction which forms an angle between −30 degrees and +30 degrees with respect to a horizontal direction in the transport configuration.

6. The lifting unit of claim 5, wherein the cylinder is in the retracted position in the transport configuration.

7. The lifting unit of claim 1, wherein the jib foot comprises an upper part and a lower part, and the upper part is located above the lower part in the service configuration with the jib foot in the lowered position, wherein the lifting unit further comprises a pivot connection having a pivot axis arranged between the jib foot and the counter-jib, and the pivot axis is located above the lower part in the service configuration with the jib foot in the lowered position, and wherein the upper part is attached to the pivot axis and the lower part is attached to the first cylinder part, and the cylinder is configured to push the jib along an axis extending substantially in a direction of extension of lower chords of the jib in the service configuration with the jib foot in the lowered position.

8. The lifting unit of claim 7, wherein the pivot axis is mechanically connected to the securing part in both the service configuration and the transport configuration.

9. The lifting unit of claim 1, further comprising a supply device configured to supply power to the cylinder for lifting the jib foot, wherein the supply device is attached to the counter-jib such that the supply device is configured to be transported with the counter-jib in the transport configuration.

10. The lifting unit of claim 9, wherein the cylinder is a hydraulic linear cylinder and the supply device is a hydraulic power unit.

11. The lifting unit of claim 10, further comprising:

conduits configured to conduct energy transmission liquid between the supply device and the cylinder, and quick couplers arranged between the cylinder and the supply device, the quick couplers being located closer to the supply device than the cylinder.

12. The lifting unit of claim 1, having a maximum length of less than 12 meters, a maximum width of less than 2.25 meters and a maximum height of less than 2.5 meters.

13. The lifting unit claim 1, wherein the securing part comprises chords assembled so as to form an undeformable assembly.

14. The lifting unit of claim 1, wherein the counter-jib and the securing part are mechanically connected by embedding.

15. A luffing jib crane comprising:

a jib configured to distribute a suspended load;

a mast configured to support the jib and the suspended load; and a lifting unit mechanically connected to the mast and secured to the jib, the lifting unit comprising:

a jib foot secured to the jib and forming a proximal part of the jib;

a counter-jib configured to support a ballast for balancing the jib;

a securing part arranged between the jib foot and the counter-jib, the securing part comprising a securing portion mechanically connected to the mast; and a cylinder comprising a first cylinder part and a second cylinder part, wherein the first cylinder part is mechanically connected to the jib foot such that the jib foot is movable between a lowered position and a lifted position in response to operation of the cylinder, and the second cylinder part is mechanically connected to the securing part.

16. A method for assembling a luffing jib crane, the luffing jib crane comprising a jib, a mast and a lifting unit, the method comprising:

erecting the mast;

attaching on the mast a rotation device of the lifting unit;

assembling the lifting unit on the rotation device; and mechanically connecting the jib to the lifting unit, wherein the lifting unit comprises:

a jib foot configured to be mechanically connected to the jib and form a proximal part of the jib;

a counter-jib configured to support a ballast for balancing the jib;

a securing part arranged between the jib foot and the counter-jib, the securing part comprising a securing portion having the rotation device configured to be attached to the mast; and a cylinder comprising a first cylinder part and a second cylinder part, wherein the first cylinder part is mechanically connected to the jib foot such that the jib foot is movable between a lowered position and a lifted position in response to operation of the cylinder, and the second cylinder part is mechanically connected to the securing part.

* * * * *